US009801480B1

(12) United States Patent
McCain

(10) Patent No.: US 9,801,480 B1
(45) Date of Patent: Oct. 31, 2017

(54) THREE-SECTION TRAVEL PILLOW WITH NECK SUPPORT AND ACTUATED LUMBAR

(71) Applicant: RG Enterprise, Int., LLC, Sun City Center, FL (US)

(72) Inventor: Glenn McCain, Sun City Center, FL (US)

(73) Assignee: RG ENTERPRISE, INT., LLC, Sun City Center, FL (US)

( * ) Notice: Subject to any disclaimer, the term of this patent is extended or adjusted under 35 U.S.C. 154(b) by 0 days.

(21) Appl. No.: 15/358,137

(22) Filed: Nov. 22, 2016

(51) Int. Cl.
*A47G 9/10* (2006.01)
*A47C 7/42* (2006.01)
*A47C 7/46* (2006.01)

(52) U.S. Cl.
CPC ..... *A47G 9/1027* (2013.01); *A47C 7/42* (2013.01); *A47C 7/46* (2013.01); *A47G 9/1081* (2013.01); *A47G 2009/1018* (2013.01)

(58) Field of Classification Search
CPC ..... A47C 7/425; A47C 27/146; A47C 7/383; A47C 7/46; A47C 7/467; A47C 27/10; A47C 27/081; A47C 27/084; A47G 9/10; A47G 2009/003; A47G 9/1027
See application file for complete search history.

(56) References Cited

U.S. PATENT DOCUMENTS

| | | | | | |
|---|---|---|---|---|---|
| 1,385,355 | A * | 7/1921 | Banks | A47G 9/10 | 5/636 |
| 3,305,878 | A * | 2/1967 | Hellbaum | A47C 27/146 | 5/630 |
| 4,862,536 | A * | 9/1989 | Pruit | A47C 7/46 | 297/230.14 |
| 5,020,168 | A * | 6/1991 | Wood | A47K 3/12 | 4/573.1 |
| 5,054,854 | A * | 10/1991 | Pruit | A47C 7/383 | 297/284.3 |
| 6,038,722 | A * | 3/2000 | Giori | A47C 27/084 | 5/709 |
| D774,804 | S * | 12/2016 | Beauliere | D6/604 | |
| 2010/0170037 | A1* | 7/2010 | Fletcher | A47C 4/54 | 5/83.1 |
| 2014/0041125 | A1 | 2/2014 | Grealy | | |

* cited by examiner

*Primary Examiner* — Eric Kurilla
(74) *Attorney, Agent, or Firm* — de la Pena & Holiday LLP

(57) ABSTRACT

A pillow that is portable and inflatable and is intended to be used when traveling is described. The pillow has three sections. A top section has an indentation for resting a user's head and neck. It has a dedicated air value which can be used to inflate it. A middle section is used for supporting a user's back. It does not have a dedicated air valve. It is sealed from the top section. No air flows between it and the top section. A bottom section has an articulated portion that protrudes out to provide support for a user's lumbar section of the back. It is connected to the middle section and has one or more passage ways for air to flow between the two sections. The bottom section has an air valve that allows a user to inflate it and in doing so also inflate the middle section.

1 Claim, 2 Drawing Sheets

THREE-SECTION TRAVEL PILLOW WITH NECK SUPPORT AND ACTUATED LUMBAR

BACKGROUND OF THE INVENTION

Field of the Invention

The present invention relates to inflatable travel pillows. More specifically, it relates to a travel pillow having three sections with neck support and lumbar support.

Description of the Related Art

Presently, many inflatable travel pillows and cushions that are one-piece provide contact with two body areas: head/neck support and lumber support. One drawback is that the neck support lacks contouring, they do not provide support at the base of the neck, specifically in the spinal region. Another drawback is that the lumbar support only provides one level of support with no extra raised lumber support. As such, they do not have full back support. The air or inflatable pillows currently available also have large bases that are likely to encroach on adjacent seats, especially in airplanes. It would be desirable to have a travel pillow that has a minimal base through contouring with emphasis on areas of the body that need support.

BRIEF DESCRIPTION OF THE DRAWINGS

References are made to the accompanying drawings, which form a part of the description and in which are shown, by way of illustration, specific embodiments of the present invention.

SUMMARY OF THE INVENTION

In one aspect of the present invention, a pillow that is portable and inflatable and is intended to be used when traveling is described. The pillow has three sections. A top section has an indentation for resting a user's head and neck. It has a dedicated air value which can be used to inflate it. A middle section is used for supporting a user's back. It does not have a dedicated air valve. It is sealed from the top section. No air flows between it and the top section. A bottom section has an articulated portion that protrudes out to provide support for a user's lumbar section of the back. It is connected to the middle section and has one or more passage ways for air to flow between the two sections. The bottom section has an air valve that allows a user to inflate it and in doing so also inflate the middle section.

DETAILED DESCRIPTION OF THE INVENTION

Example embodiments of an ad delivery system for apps executing on a mobile device are described. These examples and embodiments are provided solely to add context and aid in the understanding of the invention. Thus, it will be apparent to one skilled in the art that the present invention may be practiced without some or all of the specific details described herein. In other instances, well-known concepts have not been described in detail in order to avoid unnecessarily obscuring the present invention. Other applications and examples are possible, such that the following examples, illustrations, and contexts should not be taken as definitive or limiting either in scope or setting. Although these embodiments are described in sufficient detail to enable one skilled in the art to practice the invention, these examples, illustrations, and contexts are not limiting, and other embodiments may be used and changes may be made without departing from the spirit and scope of the invention.

An inflatable, portable travel cushion is shown in the various figures. The article is an inflatable cushion that provides support for the spinal region of the neck and the entire back, specifically the lumbar section of the back. It can be used while traveling, such as on a plane, bus, train, or ship. It can also be used on a plane, at home, or in a car. The pillow material may be open cell foam. Open cell foam is a foam with holes that when exposed to air, opens the cells which are then able to trap or hold air. When the open cell foam is enclosed in a fabric, such as polyester, it enables these self-inflating characteristics. These characteristics, along with other features, allow air to travel between certain sections of the pillow as described below.

Figure 1:
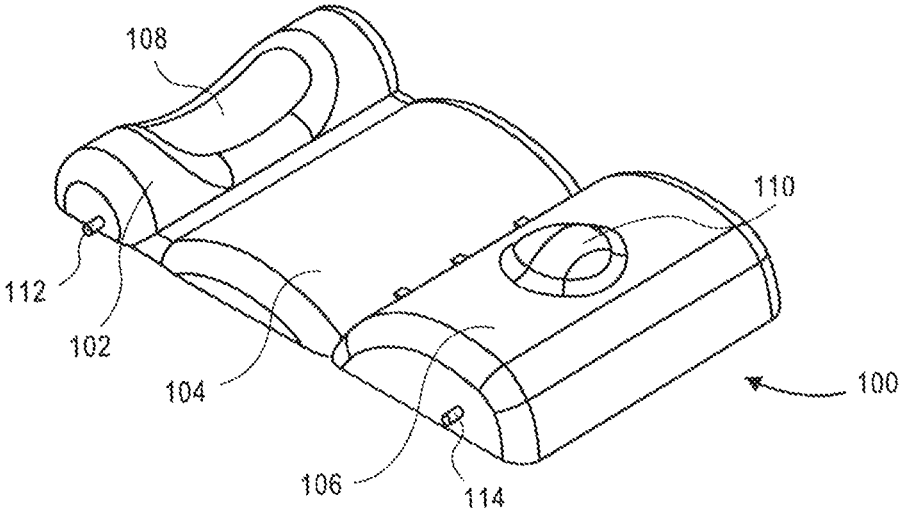
FIG. 1 is a perspective view of a travel pillow apparatus in accordance with one embodiment of the present invention.

FIG. 1 is a perspective view of a travel pillow apparatus in accordance with one embodiment of the present invention. An apparatus 100, referred to hereafter as a "travel pillow," has three sections: a head pillow section 102, a middle pillow section 104, and a lumbar section 106. Head pillow section 102 has contours that form an indentation 108. It has dimensions that make it suitable for cradling or holding in place a user's neck. More specifically, it provides support for the base of the neck and spinal region. Below head pillow 102 is middle pillow 104.

Lumbar pillow 106 has upward contours that form an articulation or protrusion 110 in the center of section 106. Articulated portion 110 is of suitable size for a typical user and is positioned so that it allows it contact with a user's lower back or lumbar, a specific section of the spine. Also shown in FIG. 1 are two air valves, 112 and 114. Valve 112 enables inflation of head rest section 102 by a user. Valve 114 enables inflation of middle section 104 and lumbar section 106 each section connected via air vents as described below.

Figure 2:
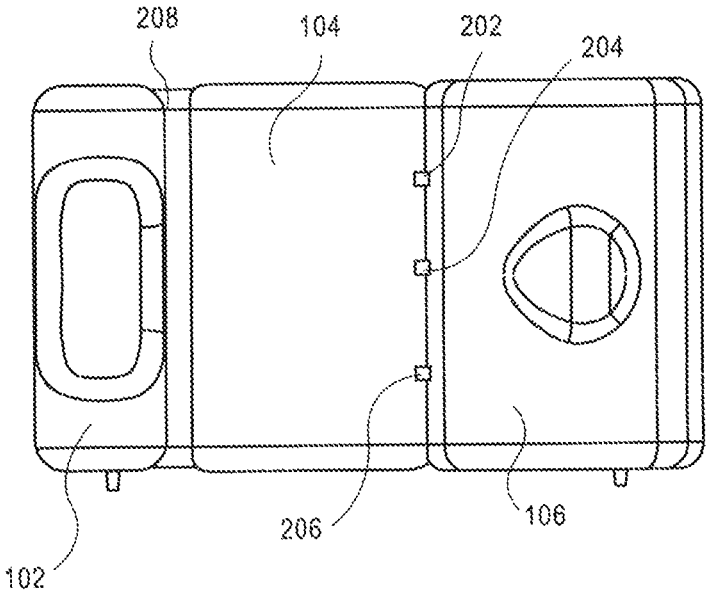
FIG. 2 is a top view of travel pillow in accordance with one embodiment.

FIG. 2 is a top view of travel pillow 100 in accordance with one embodiment. It shows sections 102, 104, and 106. In one embodiment, head section 102 is hermetically sealed from section 104; that is, no air from it flows to section 104. The seal is shown as area or strip 208. Middle section 104 and lumbar section 106 are not hermetically sealed from each other. Air vents 202, 204, and 206 allow for air to flow between the two sections. In other embodiments, there may be more or fewer vents. As such, in one embodiment, when inflating pillow 100 through air valve 114, the user is inflating sections 104 and 106. When inflating pillow 100 through air valve 112, the user is only inflating head section 102.

Figure 3:
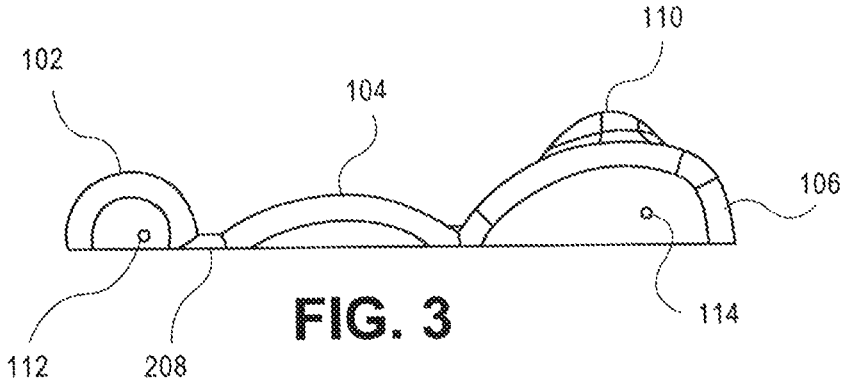
FIG. 3 is a side view of travel pillow in accordance with one embodiment.

FIG. 3 is a side view of travel pillow 100 in accordance with one embodiment. As can be seen in the figure, head section 102 has more depth (i.e., is higher) than middle section 104. Lumber section 106 also has more depth than middle section 104. As described above, articulated lumbar portion 110 extends up or protrudes from the surface of section 106 to provide extra support for the lumbar area of the user's spine. Hermetically sealed area 208 that separates head section 102 from middle section 104 is also shown. As described above, sections 104 and 106 are connected but have air vents between them (not shown in FIG. 3). In one specific embodiment, head pillow is 5" long and 3" from the base, the middle pillow is 9.25" long and 2" from the base, and lumbar section 106 is 11" long and 5" from the base. The width of travel pillow is 15 inches.

Figure 4:
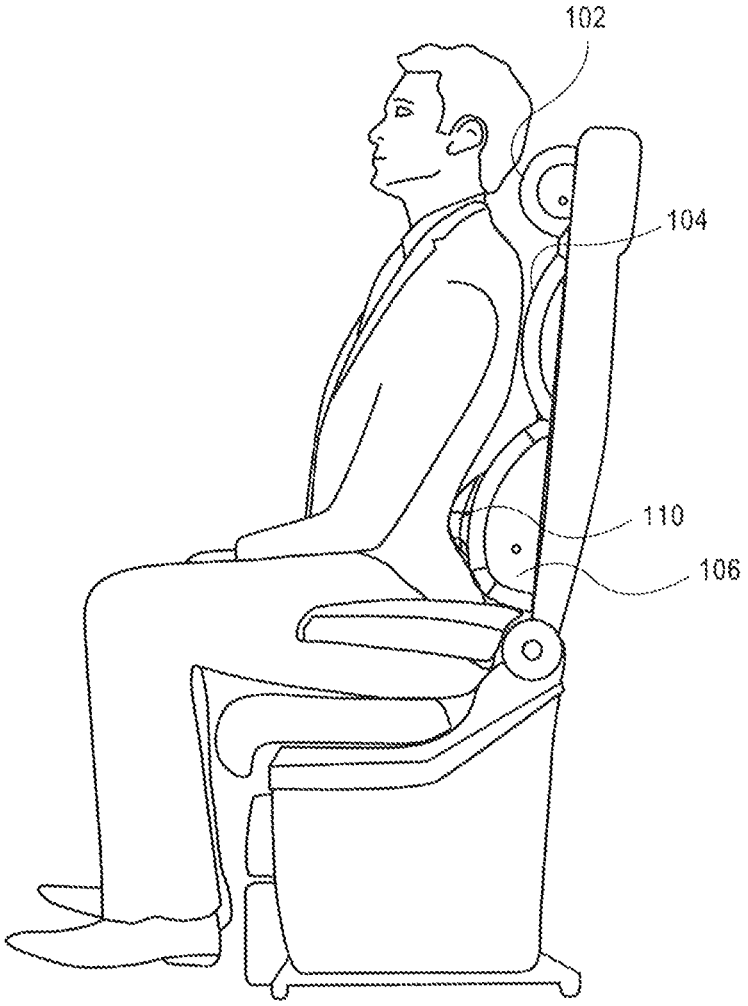
FIG. 4 is a diagram of pillow being used by a user sitting in a seat.

FIG. 4 is a diagram of pillow 100 being used by a user sitting in a seat. The user's neck is able to rest on section 102, specifically in indentation 108. The user's back rests against middle section 104. The user's lower back or lumbar is in contact with lumbar section 106, specifically in contact with actuated section 110.

In this manner, there is constant body contact and support between the user's body and pillow 100. In one embodiment, the material of pillow 100 is open cell foam. Open cell foam is a foam with holes that when exposed to air, opens the cells which are able to trap or hold air. When the open cell foam is enclosed in a fabric, such as polyester, it enables the self-inflating characteristics. In one embodiment, given that pillow 100 is made of open cell foam, air can move through air vents 202-206 between sections 104 and 106. Pillow 100 provides comfort by applying upper body support in precise areas needed for stress and tension relief, through flexibility of the foam and through air movement within its various chambers. Through gravity, the foam supplies inflatable pressure to the travel pillow thereby preventing over-inflation.

Although illustrative embodiments and applications of this invention are shown and described herein, many variations and modifications are possible which remain within the concept, scope, and spirit of the invention, and these variations would become clear to those of ordinary skill in the art after perusal of this application. Accordingly, the embodiments described are to be considered as illustrative and not restrictive, and the invention is not to be limited to the details given herein, but may be modified within the scope and equivalents of the appended claims.

What is claimed is:

1. A portable inflatable pillow made of open cell foam material, the portable inflatable pillow comprising:

a top section having an indentation for resting a neck or head of a user and having a first dedicated air valve solely for inflating the top section;

a middle section for supporting a back of the user, the middle section not having a dedicated air valve located on it, wherein the top section is hermetically sealed from the middle section so that air cannot flow between the top and middle section; and a bottom section having a protrusion attached to it, the protrusion extending away from the bottom section and providing support for a lumbar section of the back of the user, the bottom section having a second air valve, wherein the middle section and bottom section have a plurality of air vents between them so that air can flow through the second air valve and the air vents to inflate the bottom section and the middle section; and wherein the top section has a first height measured perpendicularly from a pillow base, the middle section has a second height measured perpendicularly from the pillow base, and the bottom section has a third height measured perpendicularly from the pillow base, wherein the first height is greater than the second height and the third height is greater than the first height.

* * * * *